US006178786B1

(12) United States Patent
Willmer

(10) Patent No.: US 6,178,786 B1
(45) Date of Patent: Jan. 30, 2001

(54) KNITTING MACHINE NEEDLE

(75) Inventor: Rolf Willmer, Albstadt (DE)

(73) Assignee: SIPRA Patententwicklungs- u. Beteiligungsgesellschaft mbH, Albstadt (DE)

( * ) Notice: Under 35 U.S.C. 154(b), the term of this patent shall be extended for 0 days.

(21) Appl. No.: 09/316,636

(22) Filed: May 21, 1999

(30) Foreign Application Priority Data

May 22, 1998 (DE) ..... 198 22 862

(51) Int. Cl.[7] ..... D04B 9/10
(52) U.S. Cl. ..... 66/221
(58) Field of Search ..... 66/116, 123, 120, 66/121, 221, 216, 218, 219, 220, 75.1, 75.2

(56) References Cited

U.S. PATENT DOCUMENTS 2,025,462 * 12/1935 Lombardi ..... 66/123
4,570,463 * 2/1986 Otto ..... 66/221
4,827,740 5/1989 Cottenceau et al. .
5,375,436 * 12/1994 Fucik ..... 66/221
6,014,875 * 1/2000 Lonati et al. ..... 66/221

FOREIGN PATENT DOCUMENTS 40 07 253 A1 9/1991 (DE) .
43 38 800 A1 7/1994 (DE) .
37 39 924 A1 2/1998 (DE) .
0 712 952 5/1996 (EP) .
1 281 391 7/1972 (GB) .
1 477 890 6/1977 (GB) .
1 479 790 7/1977 (GB) .
2 242 692 10/1991 (GB) .

* cited by examiner

*Primary Examiner*—Danny Worrell
(74) *Attorney, Agent, or Firm*—Michael J. Striker

(57) ABSTRACT

A knitting machine (1) comprises a shaft (2) with a recess (11) in which a selection element (12) provided with a controllable raising butt (20) is mounted swivellably and can be swivelled to and fro between a position in which the raising butt (20) is retracted into the recess (11) and a position in which the raising butt (20) projects forwards over the front side of the shaft (2). A spring (21), which can be attached to the selection element (12) or the shaft (2), serves to pre-tension the selection element (12) into one of these two positions (FIG. 1).

13 Claims, 4 Drawing Sheets

KNITTING MACHINE NEEDLE

BACKGROUND OF THE INVENTION

The invention relates to a knitting machine needle with a shaft having a front or upper side and a back and said shaft having a recess open towards the front side, which recess receives at least partly a selection element provided with a controllable raising butt, the selection element being arranged rotatably or swivellably relative to the shaft in such a manner that said selection element can be swivelled into at least a first position, in which the raising butt (20) is retracted behind the front side and a second position in which the raising butt projects forwards over the front side.

Knitting machines for producing patterned knitwear are provided on their knitting systems with mechanically, electrically or electromagnetically operating selection devices which serve for the purpose of selecting individually knitting needles, which are guided in the grooves of a needle bed, for knitting, non-knitting or tuck operations and if necessary for producing transfer patterns (flat knitting machines). The selection devices operate thereby predominantly on jacks and other selection elements which are individually assigned to normal knitting machine needles, especially latch-type needles and as a rule are arranged beneath the needles but in the same grooves as the latter (DE 37 39 924 A1).

Selection devices of this type have proved their worth in numerous embodiments and operate perfectly as long as the selection in question is of knitting needles which are mounted displaceably in comparatively high needle beds such as in the needle cylinders of circular knitting machines, in the needle beds of flat knitting machines or the like, since there is adequate space in such needle beds underneath the knitting needles to accommodate the selection elements there which are useful for the needle selection. In conjunction with other needle beds, such as e.g. the dials of circular knitting machines, selection devices of this type are less well suited by contrast since dials or the like are provided with comparatively short grooves, as a design condition, and hence can frequently not receive any additional selection elements.

Thus, a special knitting machine needle of the type indicated at the beginning has become known already (U.S. Pat. No. 4,827,740, DE 40 07 253 C2, DE 43 38 800 A1), which has a swivellable selection element integrated in the needle shaft. The swivelling of these selection elements in accordance with the pattern is produced by firstly bringing all the selection elements into a pre-set swivel position with the help of a depressing cam part before the knitting needles enter into a knitting system and then leaving said selection elements in the area of a selection point lying behind the depressing cam part in this position in accordance with the pattern by means of electromagnetic or otherwise controlled means or transferring said selection elements into another position. A raising butt attached to the selection element is, according to the position of the selection element arranged either essentially in front of the front side or above the upper side of the knitting needle, so that said raising butt is engaged by a raising curve arranged behind the selection point and can be lifted together with the knitting needle, or essentially retracted behind the front or upper side of the knitting needle and into the recess so that it cannot be gripped by the raising curve, i.e. the knitting needle is not raised.

Knitting machine needles with integrated selection imply the special advantage that in the grooves of the needle beds there is no requirement for additional space or only very little for accommodation of the selection elements so that they are suitable especially as dial needles. Though, a problem exists in that two butts of the selection elements have to be operated always for swivelling according to a pattern and in fact either with hammer needles on one butt and with depressing cam parts on the other butt, respectively (DE 40 07 253 C2), or with a selection magnet each on both butts and an additional depressing cam part in a central area (DE 43 38 800 A1). As a result, either a certain susceptibility to faults in the selection device must be taken into account of a reduced operational speed of the knitting machine must be accepted in order to avoid pattern faults. In addition, several switching and control parts are required to produce one or the other position.

SUMMARY OF THE INVENTION

It is, therebefore, an object of this invention to design the knitting machine needle mentioned above such that the selection elements can be selected with high operating reliability.

A further object is to provide high operating reliability with a simple construction of the needle.

Yet another object of this invention is to design the knitting machine needle such that high operational speeds can be achieved.

These and other objects are solved by a knitting machine needle which is characterized in that it has a spring pre-tensioning the selection element into one of the two positions.

BRIEF DESCRIPTION OF THE DRAWINGS

Further advantageous features of the invention are suggested in the sub-claims.

The invention is described subsequently in more detail in the embodiments, given by way of example, in conjunction with the accompanying drawings which show.

DESCRIPTION OF PREFERRED EMBODIMENTS

Figure 1:
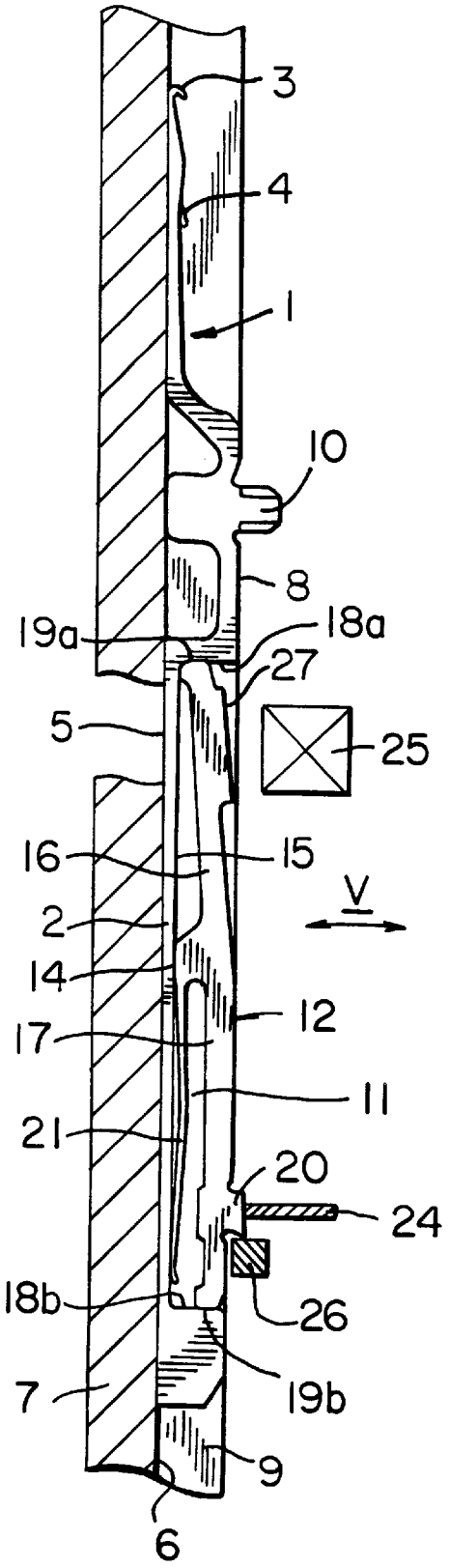
FIGS. 1 and 2 side views of a preferred embodiment of a knitting machine needle according to the invention in different swivel positions of a selection element.
Figure 2:
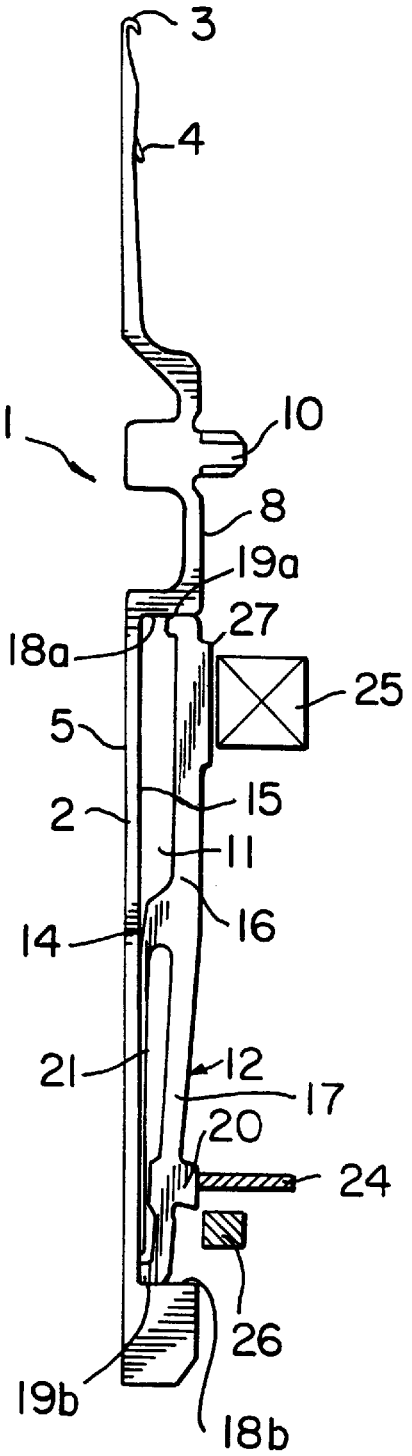

According to FIGS. 1 and 2, a knitting machine needle 1 according to the invention designed here as a latch-type needle contains a shaft 2, the upper end of which is provided in a normal fashion with a hook 3 and a latch 4. The shaft 2 further contains a back 5, with which said shaft is guided displaceably on the base 6 of a groove of a needle bed 7 which is indicated only in FIG. 1 and in a rough schematic manner, and a front or upper side 8 which, when the shaft 2 is mounted in the needle bed 7, essentially ends flush with the upper or front side of the webs 9 (FIG. 1) forming the grooves. An operating butt 10 which is fixed rigidly in an upper section of the shaft 2 and protrudes over the front side 8 and projects thereby permanently out of the groove.

In a central or lower section of the shaft 2, there is formed a pocket-shaped recess 11 which opens towards the front side 8 and in which a selection element is arranged. In the embodiment according to FIGS. 1 and 2, the length of the recess 11, measured parallel to the back 5 or to the axis of the shaft 2, is equal to the correspondingly measured length of the selection element 12 so that an axial movement of the selection element 12 relative to the shaft 2 is practically impossible. On the other hand, the selection element 12 within the recess 11 can be swivelled or rotated around an axis which extends perpendicular to the side walls of the shaft 2, i.e. in FIGS. 1 and 2 perpendicular to the plane of the drawing and perpendicular to the shaft axis, as is indicated schematically in FIG. 1 by a double arrow v. The swivelling takes place in the area of a bearing 14 which is arranged in a central part of the recess 11 and which comprises here a supporting surface formed on the rear side of the selection element 12, by means of which supporting surface the selection element 12 is supported on a base 15 of the recess 11. Moreover, the selection element is designed essentially as a two-armed lever which, proceeding from the bearing 14, has a first, upwardly projecting lever arm 16 and, on the opposite side of the bearing 14, has a second, downwardly directed lever arm 17. In addition both the recess 11 and the selection element 12 are provided on upper and lower ends with co-operating sliding or guiding surfaces 18*a*, 18*b* and 19*a*, 19*b* which are arranged transversely to the base 15 and formed arc-shaped according to the swivelling radius of the selection element 12.

The selection element 12 has furthermore a controllable raising butt 20. By the designation "controllable" raising butt base 20 is thereby understood that, contrary to the operating butt 10, the butt in question can adopt according to choice and depending upon the swivelling state of the selection element 12 two preferred positions, namely either a raising position (FIG. 1) in which said butt projects out over the front side 8 of the shaft 2 or a non-raising or pass-through position (FIG. 2) in which said butt is essentially retracted completely behind the front side 8 of the shaft 2 and into the recess 11.

Finally, the knitting needle 1 according to the invention has a spring 21 which pretensions the selection element 12 into one of the two positions according to FIGS. 1 and 2. In the embodiment, the spring 21 is designed as a resilient spring which is fixed roughly in the area of the bearing 14 onto the rear side of the selection element 12, arranged between the base 15 of the recess 11 and the rear side of the lower lever 17 and is supported on the base 15 such that said spring holds the lever arm 17 normally swivelled away from the base 15 so that the controllable expulsion butt 20 projects over the front side 8 (FIG. 1).

Because of the described pre-tension of the selection element 12, a selection device which is not shown in detail needs to contain only two elements, namely a depressing cam part 24 operating on the controllable raising butts 20 and a selection member 25 e.g. an electric magnet which is controllable according to the pattern, both being indicated schematically only in FIGS. 1 and 2 and being arranged in front of a normal knitting system which is provided with a raising cam part 26 which is likewise only indicated schematically. The selection can result thereby in a simple manner in that the selection elements 12 proceed firstly into the region of the depressing cam part 24 and from the latter, independently of which position they just have in that moment, are swivelled according to FIG. 2 against the force of the associated springs 21 into the position in which the raising butts 20 are sunk into the recesses 11 and hence are arranged out of the operational area of the raising cam part 26. Consequently, anchor surfaces 27, which are provided on the upper lever arms 16 of the selection elements 12 and are formed essentially by the front surfaces of the selection elements 12, are swivelled at the same time to the front or upwards until said anchor surfaces project a little over the front side 8 of the shafts 2 and come into contact with a control pole of the selection member 25. If the selection member 25 is fed with electric signals such that the control pole exerts an attractive force on the anchor surfaces 27 of the selection elements 12 which is greater than the force of the springs 21 then the raising butts 20 remain even in the further course of the procedure out of the operational area of the raising cam part 26 so that said raising butts move past the latter without the associated needles 1 being raised. If the selection magnet 25 on the other hand is controlled such that its control pole does not adequately attract the anchor surfaces 27 then the selection elements 12 are swivelled back by the associated springs 21 into the position which is shown in FIG. 1 so that the raising butts 20 run onto the raising cam part 26 and the associated needles 1 are directed by the butts 10, 20 into raising paths from which they are withdrawn again before reaching the next knitting system.

The described knitting machine needle implies the substantial advantage that the selection elements 12 only need to have one single butt ad hence a comparatively simple control is possible with few parts which have proved reliable e.g. in electromagnetic selection devices. In particular, it is not necessary to select the sections elements 12 with the help of hammer needles and/or by applying special depressing cam parts.

Figure 3:
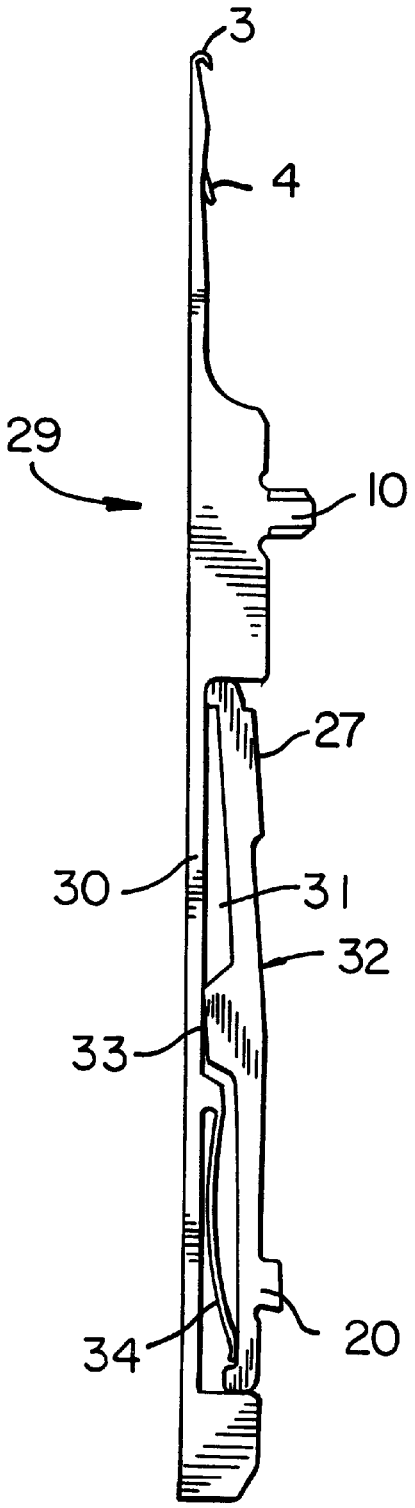
FIG. 3 a view, corresponding to FIG. 1, of a second embodiment of the knitting machine needle according to the invention.

FIG. 3 shows a further embodiment of a knitting machine needle 29 according to the invention with a shaft 30 which has a recess 31 in which a selection element 32 is located swivellably by means of a bearing 33. The needle 29 corresponds to the needle 1 according to FIGS. 1 and 2 apart from the difference that a spring 34 designed as a resilient spring is attached no to the selection element 32 but tightly beneath the bearing 33 to the shaft 30.

Figure 4:
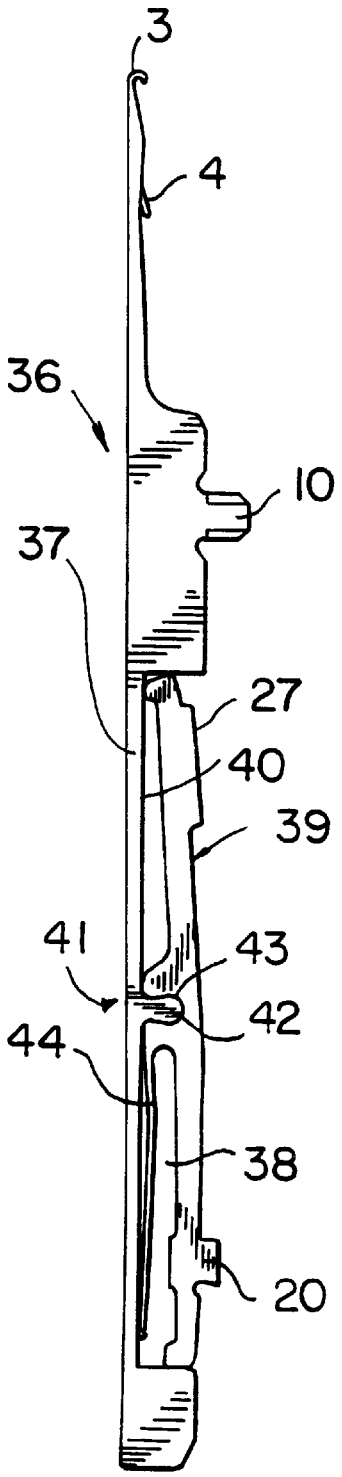
FIGS. 4 and 5 the views, corresponding to FIGS. 1 and 2, of a third embodiment of the knitting machine needle according to the invention, and FIG. 6 a view corresponding to FIG. 1 of a fourth embodiment of the knitting machine needle according to the invention.
Figure 5:
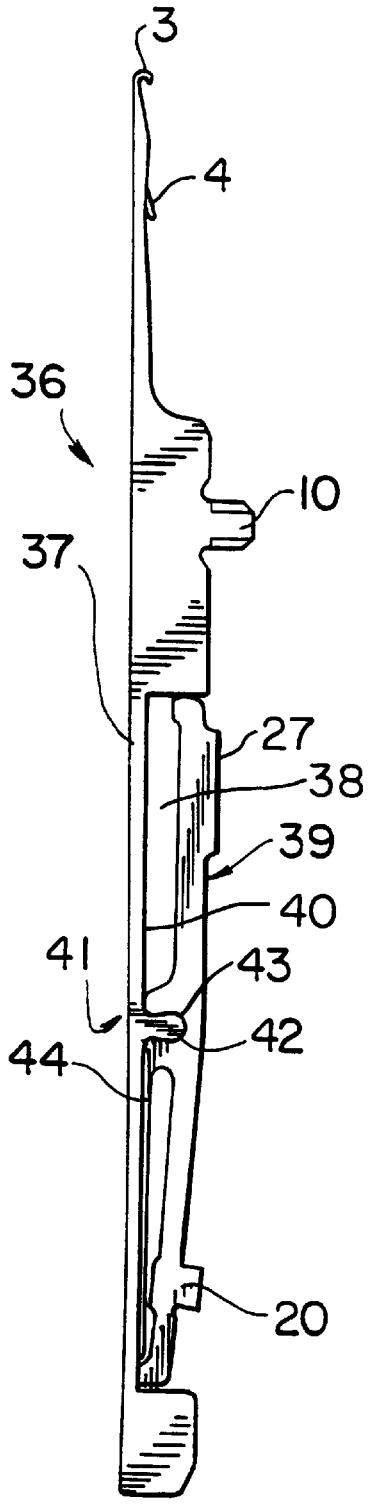

FIGS. 4 and 5 show a further embodiment of the knitting machine needle 36 according to the invention, corresponding essentially to the embodiment according to FIGS. 1 and 2, with a shaft 37, a recess 38 and a selection element 39. The selection element 39 is connected here swivellably to the shaft 37 by means of a swivelling bearing 41 and not supported, as in FIGS. 1 and 2, by means of a bearing on a base 40 of the recess 38. The swivelling bearing 41 is formed e.g. by an articulated part 42 attached to the base 40 of the recess 38 in the form of a cylindrical extension or swivelling pin and an articulated part 43 attached to the rear side of the selection element 39 and mounted on the articulated part 42 in the form of a bearing lug. Alternatively the articulated part 43 could also be attached to the shaft 37 and the articulated part 42 to the selection element 39. A spring 44 is designed analogously to FIGS. 1 and 2 and fixed tightly beneath the articulated part 43 onto the selection element 39. Alternatively, the spring 44 could also be fixed onto the shaft 37 analogously to FIG. 3. In addition, the sliding surfaces 18*a*, 18*b* or 19*a*, 19*b* shown in FIGS. 1 and 2 could be omitted in the embodiment according to FIGS. 4 and 5 since the swivelling bearing 41 holds the selection element 39 axially unmoveably to the shaft 37 and prevents it from falling out.

Figure 6:
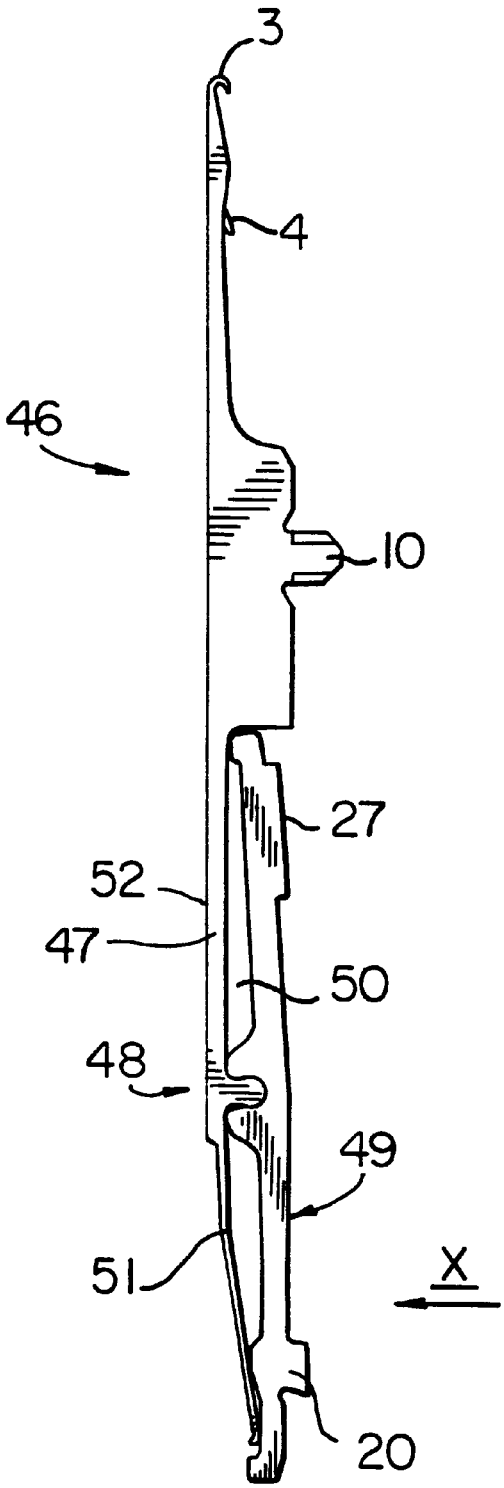

In the embodiment, shown in FIG. 6, of a knitting machine needle 46 according to the invention, a shortened shaft 47 is provided which terminates closely behind a swivelling bearing 48, designed analogously to FIGS. 4 and 5, for a selection element 49. A recess 50 in that shaft 47 is correspondingly shortened and thereby opens downwards so that the selection element 49 mounted on the shaft 47 by means of the swivelling bearing 48 corresponding to FIGS. 4 and 5 projects by roughly half freely out of the recess 50. A spring 51 is attached to the shaft 47 analogously to FIG. 3 and designed in transverse section as an extension of the same. In contrast to the other embodiments, the spring 51 is hence not supported on the base of the recess 50 in any of the swivelling positions.

FIG. 6 shows the normal position of the spring 51 which adjoins with its free end the lower lever arm of the selection element 49 and pre-tension said lower lever arm forwards in the opposite direction from an arrow x. If the lower member of the selection element 49 is pressed in the direction of the arrow x in FIG. 6 and in the direction of a back 52 of the shaft 47, e.g. with the help of the depressing cam assembly part 24 according to FIGS. 1 and 2, then the spring 51 is tensioned analogosly to the other embodiments such that, when the selection element 49 is released again, said spring swivels the latter back into the position according to FIG. 6.

Moreover, the arrangement and design of the needles, 1, 29, 36 and 46 are essentially identical for which reason identical parts are provided throughout with the same reference numbers.

The invention is not limited to the described embodiments, given by way of example, which can be changed in many different ways. In particular, the needle according to the invention could be designed also as a hook-type needle or as a shaft section of a compound needle. Furthermore, the special anchor surface 27 can if required be arranged on the same side as the controllable raising butt 20 since this depends on the type and position of the selection used in one particular case. Accordingly, it would be possible to arrange the selection elements in upper parts of the needle shafts and to fix the rigid butts 10 beneath the selection elements. Furthermore, the selection element 12, 32 in the embodiments according to FIGS. 1 to 3 could be held in the recess, analogously to FIGS. 4 to 6, in such a way that said selection element can in fact only be inserted into said recess or extracted out of said recess from the sides but not being able to be extracted towards the front side 8. Consequently it is avoided that the selection element is undesirably pushed out of the recess by the force of the spring if it is not held from the front by a cam part or the like. Furthermore, shapes other than those shown in FIGS. 1 to 6 are conceivable for the selection element. It is further obvious that the selection elements, deviating from the preferred embodiments shown in the drawings, could be mounted also axially displaceably in the recesses. In such a case, it could be also be ensured, by means of additional cam parts operating if necessary on additional butts of the selection elements, that the selection elements adopt the correct axial positions relative to the depressing cam parts 24, the selection members 25 and the raising cam parts 26 when moving into the selection points. In particular, the springs could thereby operate also on the respectively upper lever arm and/or comprise separate spring elements joined to the selection element or the shaft although the described design makes possible an especially easy production of the shaft and of the selection element including the spring by means of punching. In conclusion, it is understood that the individual features can be used also in combinations other than those shown and described.

What is claimed is:

1. Knitting machine needle comprising a shaft (2, 30, 37, 47) having a front side (8) and a back (5, 52), said shaft having a recess (11, 31, 38, 50) open towards the front side (8); a selection element (12, 32, 39, 49) being received at least partly in said recess and being provided with a controllable raising butt (20) for selectively raising or not raising said needle, said selection element (12, 32, 39, 49) being arranged swivellably relative to the shaft (2, 30, 37, 47) in such a manner that said selection element can selectively be swivelled into at least a first position in which aid raising butt (20) projects forwards over the front side (8) for raising said needle in cooperation with a raising cam part (26), and a second position, in which said raising butt (20) in retracted behind the front side (8) such that said needle is not raised by said raising cam part (26), and a spring (21, 34, 44, 51) pretensioning said selection element (12, 32, 39, 49) into one of the two positions.

2. Knitting machine needle according to claim 1, wherein said spring (21, 44) is fixed on the selection element (12, 39).

3. Knitting machine needle according to claim 1, wherein said spring (34, 51) is fixed on the shaft (30, 47).

4. Knitting machine needle according to claim 1, wherein said recess (11, 31, 38) receives the selection element (12, 32, 39) essentially completely.

5. Knitting machine needle according to claim 4, wherein said selection element (12, 32, 39, 49) is provided on a rear side with a bearing (14, 33, 41, 48) supported on a base (15, 40) of the recess (11, 31, 38, 50) and is designed in the manner of a two-armed lever which base one lever arm (16, 17) respectively on opposite sides of said bearing (14, 33, 41, 48).

6. Knitting machine needle according to claim 5, wherein said recess (11, 31) and said selection element (12, 32) are provided on upper and lower ends with co-operating sliding surfaces (18*a*, 18*b*; 19*a*, 19*b*) which are designed arc-shaped.

7. Knitting machine needle according to claim 5, wherein said bearing (41, 48) comprises a swivelling bearing which is formed from articulated parts (42, 43) which are mounted on said rear side of the selection elements (39, 49) and on said base (40) of said recess (38, 50) and which connect said selection element (39, 49) and said shaft (37, 47) to one another swivellably.

8. Knitting machine needle according to claim 5, wherein said spring (21, 34, 44) is arranged between one of said lever arms (16, 17) and said base (15, 40) of said recess (11, 31, 38).

9. Knitting machine needle according to claim 7, wherein said recess (50) is designed open towards an underside of said shaft (47) and said spring (51) is designed as a lower extension of said shaft (47) and wherein said selection element (49) has a section projection downwards out of said recess (50) and abutting said spring (51).

10. Knitting machine needle according to claim 1, wherein said selection element (12, 32, 39, 49) is provided with an anchor surface (27) for an electromagnetic selection member (25).

11. Knitting machine needle according to claim 10, wherein said, anchor surface (27) is arranged on an opposite side of said bearing (14, 33, 41, 48) in comparison to the raising butt (20).

12. Knitting machine needle according to claim 1, and further having a rigid operational butt (10).

13. Knitting machine needle according to claim 1, wherein said selection element (12, 32, 39, 49) is arranged axially in an essentially undisplaceable manner relative to the shaft (2, 30, 37, 47).

* * * * *